US010190403B2

(12) United States Patent
Samuel et al.

(10) Patent No.: US 10,190,403 B2
(45) Date of Patent: Jan. 29, 2019

(54) SYSTEM AND METHOD FOR PREDICTING AND VISUALIZING DRILLING EVENTS

(71) Applicant: LANDMARK GRAPHICS CORPORATION, Houston, TX (US)

(72) Inventors: Robello Samuel, Houston, TX (US); Umesh N. Reddy, Houston, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 260 days.

(21) Appl. No.: 14/655,284

(22) PCT Filed: Jan. 3, 2013

(86) PCT No.: PCT/US2013/020064

§ 371 (c)(1),
(2) Date: Jun. 24, 2015

(87) PCT Pub. No.: WO2014/107149

PCT Pub. Date: Jul. 10, 2014

(65) Prior Publication Data

US 2015/0315897 A1 Nov. 5, 2015

(51) Int. Cl.
*E21B 47/00* (2012.01)
*E21B 47/08* (2012.01)
(Continued)

(52) U.S. Cl.
CPC ..... *E21B 47/0002* (2013.01); *E21B 41/00* (2013.01); *E21B 44/00* (2013.01); *E21B 47/06* (2013.01); *E21B 47/08* (2013.01)

(58) Field of Classification Search
None
See application file for complete search history.

(56) References Cited

U.S. PATENT DOCUMENTS 5,952,569 A 9/1999 Jervis et al.
7,878,268 B2 2/2011 Chapman et al.
(Continued)

FOREIGN PATENT DOCUMENTS

EP 0209343 A2 1/1987

OTHER PUBLICATIONS

"A Comprehensive Approach to Well-Collision Avoidance" by Poedjono et al., Apr. 2007.*
(Continued)

*Primary Examiner* — Evren Seven

(57) ABSTRACT

Predicting and visualizing drilling events. At least some of the example embodiments are methods including: receiving data indicative of location of a first wellbore; identifying an offset well, the offset well within a predetermined distance of the first wellbore, the identifying by the computer system based on the data indicative of location of the first wellbore; reading data associated with the offset well, the reading by the computer system; generating a value indicative of probability of occurrence of a drilling event based on the data associated with the offset well; plotting the value indicative of probability of occurrence of the drilling event associated with a direction relative to the first wellbore, the plotting on a display device coupled to the computer system; and then adjusting a drilling parameter of the first wellbore based on the value indicative of probability of occurrence of the at least one drilling event.

30 Claims, 8 Drawing Sheets

(51) Int. Cl.

| | |
|---|---|
| ***E21B 47/06*** | (2012.01) |
| ***E21B 41/00*** | (2006.01) |
| ***E21B 44/00*** | (2006.01) |

(56) References Cited

U.S. PATENT DOCUMENTS

| | | | | |
|---|---|---|---|---|
| 7,970,545 | B2 | 6/2011 | Sanstrom | |
| 8,199,166 | B2 | 6/2012 | Repin et al. | |
| 9,187,984 | B2 * | 11/2015 | Usadi | G06F 17/5018 |
| 9,482,084 | B2 * | 11/2016 | Chang | E21B 44/00 |
| 9,598,947 | B2 * | 3/2017 | Wang | E21B 44/00 |
| 2004/0220846 | A1 * | 11/2004 | Cullick | G06Q 10/06 705/7.22 |
| 2005/0209836 | A1 * | 9/2005 | Klumpen | G05B 19/41885 703/10 |
| 2005/0209886 | A1 * | 9/2005 | Corkern | G06Q 50/22 705/2 |
| 2005/0228905 | A1 * | 10/2005 | Veeningen | G06Q 10/0635 710/1 |
| 2005/0236184 | A1 * | 10/2005 | Veeningen | E21B 10/00 175/40 |
| 2006/0197759 | A1 * | 9/2006 | Fremming | G01V 1/30 345/420 |
| 2007/0112547 | A1 * | 5/2007 | Ghorayeb | E21B 41/00 703/10 |
| 2009/0234623 | A1 | 9/2009 | Germain et al. | |
| 2010/0211423 | A1 | 8/2010 | Hehmeyer | |
| 2011/0199862 | A1 | 8/2011 | Pop | |
| 2012/0158761 | A1 | 6/2012 | Aamodt et al. | |
| 2012/0241217 | A1 | 9/2012 | Davis et al. | |

OTHER PUBLICATIONS

European Patent Office, Supplementary European Search Report and Written Opinion, dated Nov. 22, 2016, 8 pages, Europe.

Walt Aldred et al, Managing Drilling Risk, Oct. 11, 1999, 18 pages, Oilfield Review.

International Search Report and Written Opinion, dated Sep. 17, 2013, 19 pages; Korean International Searching Authority.

* cited by examiner

SYSTEM AND METHOD FOR PREDICTING AND VISUALIZING DRILLING EVENTS

CROSS-REFERENCE TO RELATED APPLICATIONS

This application is a U.S. National Stage patent application of International patent application Ser. No. PCT/US2013/020064, filed on Jan. 3, 2013, the benefit of which is claimed and the disclosure of which is incorporated herein by reference in its entirety.

BACKGROUND

A number of issues may arise when drilling a well into a hydrocarbon bearing formation. The issues that arise may be a result of the formation itself; for example, fractures within shale formations that extend to nearby wells may occur, or the well may experience a wellbore collapse. In some cases, there may be a correlation between drilling issues that have arisen in nearby wells, and drilling issues likely to occur during drilling of a particular well. Thus, data received and analyzed with regard previously drilled wellbores may be useful in helping prepare for potential drilling issues with respect to the drilling of new wells.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection.

Thus, if a first device couples to a second device, that connection may be through a direct connection or through an indirect connection via other devices and connections.

"Wellbore" shall mean a hole drilled into the Earth's crust used directly or indirectly for the exploration or extraction of natural resources, such as oil, natural gas, or water.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments are directed to methods and systems of calculating the probability of potential drilling events and providing real-time visualization of the probabilities. In particular, a region around a planned or partially-drilled wellbore is scanned to identify previously drilled wellbores. Data related to the previously drilled wellbores is received by a computer system, and probabilities are calculated and plotted in some example systems as a plurality of heat-maps. Based on analysis of the data and the heat-maps, drilling parameters for a partially-drilled, or planned, wellbore may be adjusted to lower the possibility of experiencing drilling issues. The specification first turns to a discussion of scanning regions around the wellbore of interest.

Figure 1:
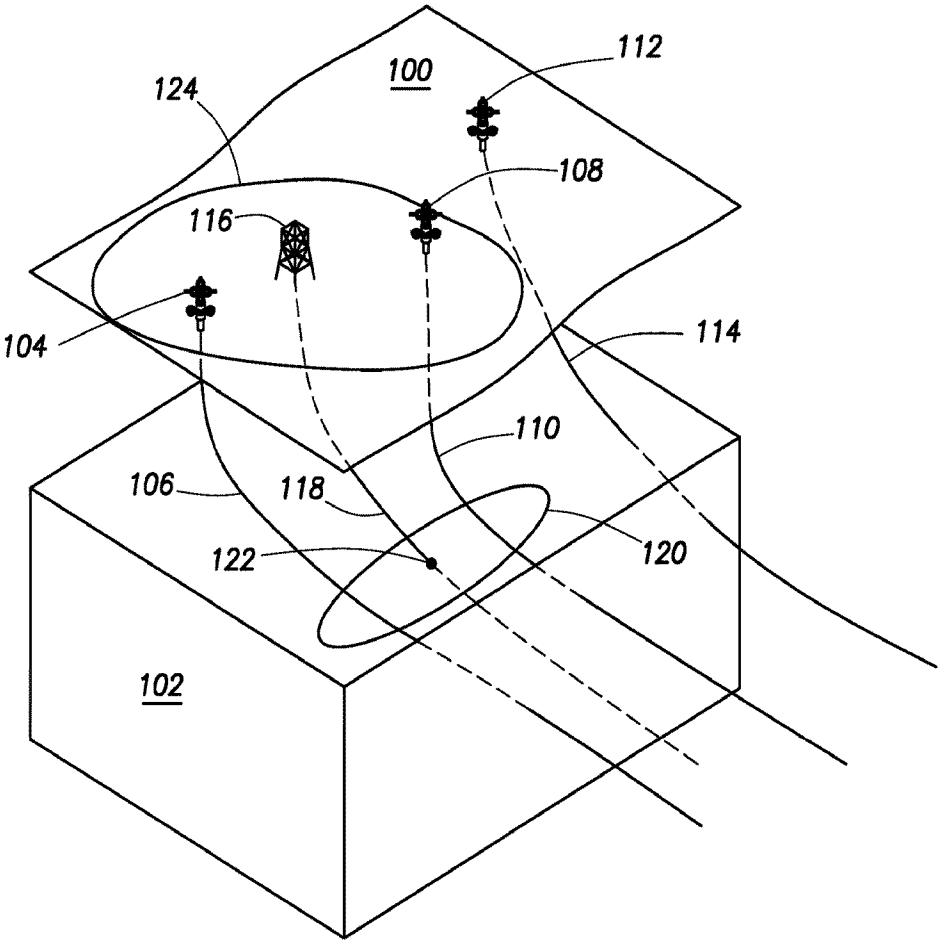
FIG. 1 shows a perspective cutaway view of a portion of hydrocarbon bearing formation in accordance with at least some embodiments.

FIG. 1 shows a perspective cutaway view of a portion of the earth's crust. In particular, FIG. 1 shows the surface 100 of the earth. Below the surface 100 is a portion of a hydrocarbon bearing formation 102. The overburden layers between the surface 100 and the hydrocarbon bearing formation 102 are not shown so as to not unduly complicate the figure. FIG. 1 also shows several wellbores drilled into the hydrocarbon bearing formation. For example, wellbores 106, 110 and 114 are shown to be wellbores extending through the hydrocarbon bearing formation 102. Wellbores 106, 110, and 114 are associated with wellheads 104, 108 and 112, respectively, to illustrate that the wellbores 106, 110 and 114 have been previously drilled. In the industry, wellbores 106, 110, and 114 may be referred to as "offset wells" when discussed in relation to wellbores which are planned or currently being drilled, and thus will be referred to herein as offset wells 106, 110, and 114. In addition, FIG. 1 shows derrick 116 associated with partially drilled wellbore path 118. In other cases, wellbore path 118 may be a planned path (i.e., drilling has not yet begun), but for purposes of explanation it will be assumed that drilling for the wellbore 118 has already partially begun.

As wellbore 118 is drilled into the hydrocarbon bearing formation, the wellbore 118 may experience any of a number of drilling events that could affect the production value of the well. For example, wells drilled into an earth formation may experience: a stuck-pipe situation; a collapse of the wellbore; a tight hole; a loss of circulating fluid; a fracture of the formation extending to an offset well; or a blowout. Thus, data regarding drilling events may be analyzed with respect to offset wells in proximity to the wellbore 118 (and its planned path) in order to determine the probability of such drilling events in wellbore 118 and make adjustments.

In order to determine the offset wells upon which the probability is calculated, a computer system may logically scan a region associated with wellbore 118. In one embodiment, the scan may be of a circular region centered at the distal end 122 of wellbore 118, such as circular region 120. In this embodiment, circular region 120 defines a plane that is perpendicular to the drilling direction of the wellbore path 118 at distal end 122 (in the view of FIG. 1, circular region 120 thus appears elliptical). In another embodiment, however, the circular region 124 may define a plane parallel to surface 100.

Figure 2:
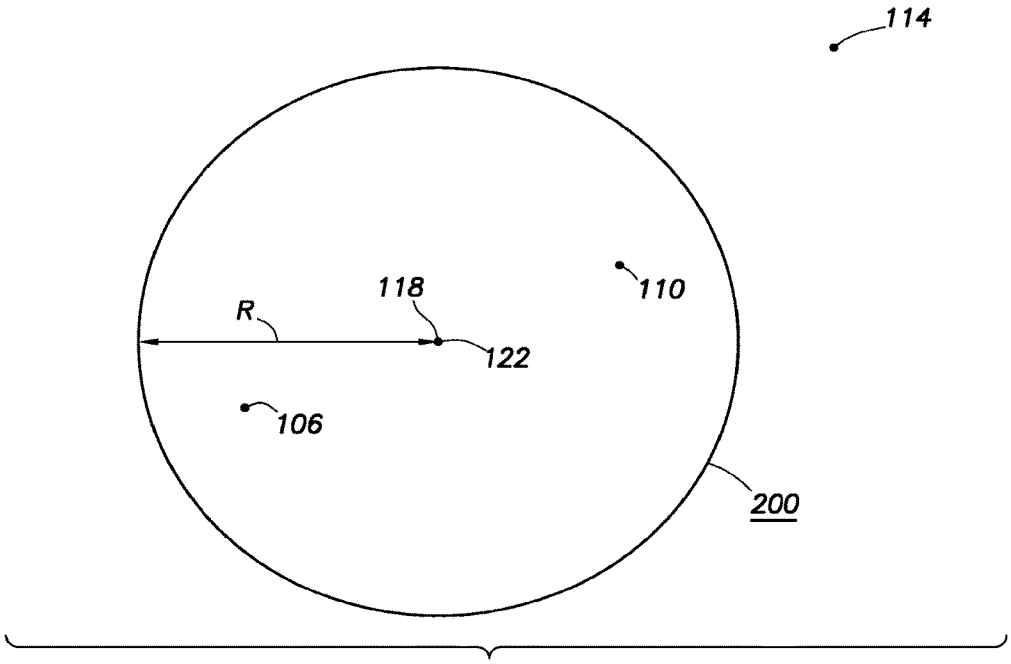
FIG. 2 shows an example scanned region in accordance with at least some embodiments.

FIG. 2 shows example circular region 200 in accordance with at least some embodiments. In one embodiment, circular region 200 may be indicative of the viewer looking down the path of wellbore 118 at the distal end 122, such as may be indicated by circular region 120 from FIG. 1. In another embodiment, circular region 200 may be circular region 124 from FIG. 1 as viewed from above; in other words, a circle with radius "r" extending away from the wellbore 118 at the surface of the earth, such that if the circular region 200 extended downward into the ground, the hole made from the circular region would extend perpendicularly into the earth.

The circular region can be thought of as defining an area within which, if offset wells are present, drilling events experienced with respect to such offset wells may be relevant to wellbore 118. For example, of the three offset wells shown in FIG. 1, offset wells 106 and 110 fall within the circular regions 122 and 124. Looking again at FIG. 2, a scan of the region defined by circular region 200 around wellbore 118 or the distal end 122 of wellbore 118 has identified two offset wells within the proximity—offset well 106 and offset well 110. In this example, offset well 114 is located outside of the scanned region and thus any data related to offset well 114 will not be considered. In this example, two of the three offset wells are identified as being located within the scanned circular region; however, since the size and orientation the scanned area may vary, greater or fewer offset wells may be identified.

Figure 3:
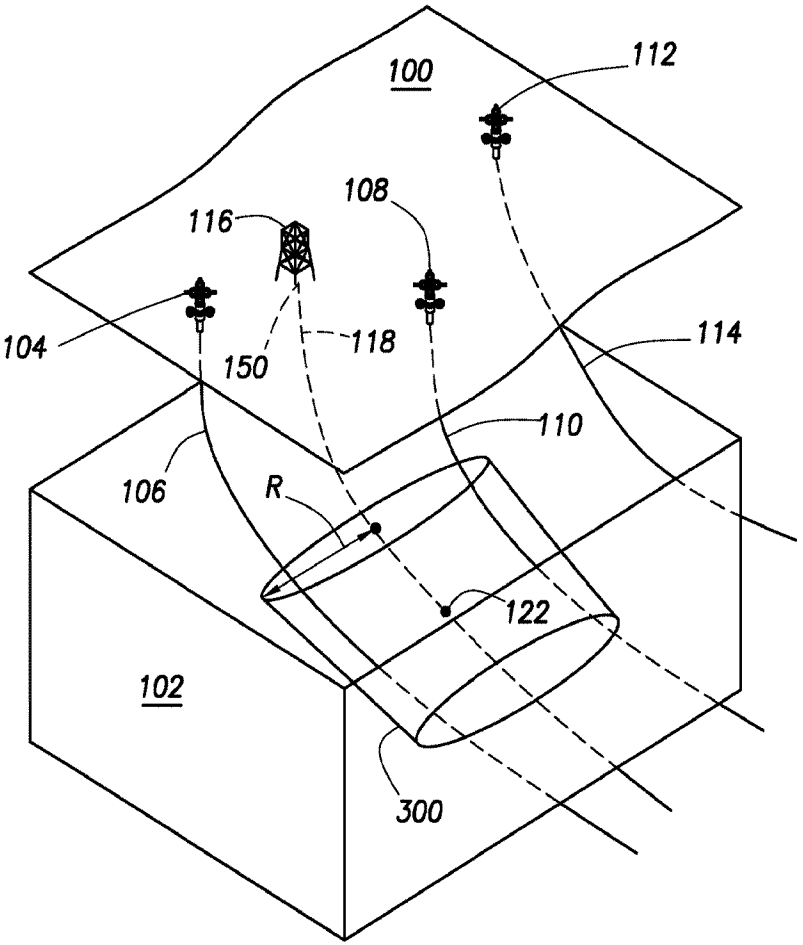
FIG. 3 shows a perspective cutaway view of a portion of a hydrocarbon bearing formation in accordance with at least some embodiments.

FIG. 3 shows a perspective, cut-away view of the earth's crust similar to FIG. 1. In FIG. 3, however, the scanned region is shown as cylindrical volume, rather than circular area. The example cylindrical region 300 defines a volume relative to wellbore 118, where the central axis of the cylindrical region 300 is coaxial with the wellbore 118. In one embodiment, and as shown, cylindrical region 300 may be a cylindrical volume having a central axis coaxial with the distal end 122 of wellbore 118. In another embodiment (not specifically shown in FIG. 3), the cylindrical region 300 may be a cylindrical volume having a central axis coaxial with the proximal end 150 of the wellbore 118 (e.g., where the cylindrical region 300 logically has an end that defines a circular area that is parallel to surface 100).

Figure 4:
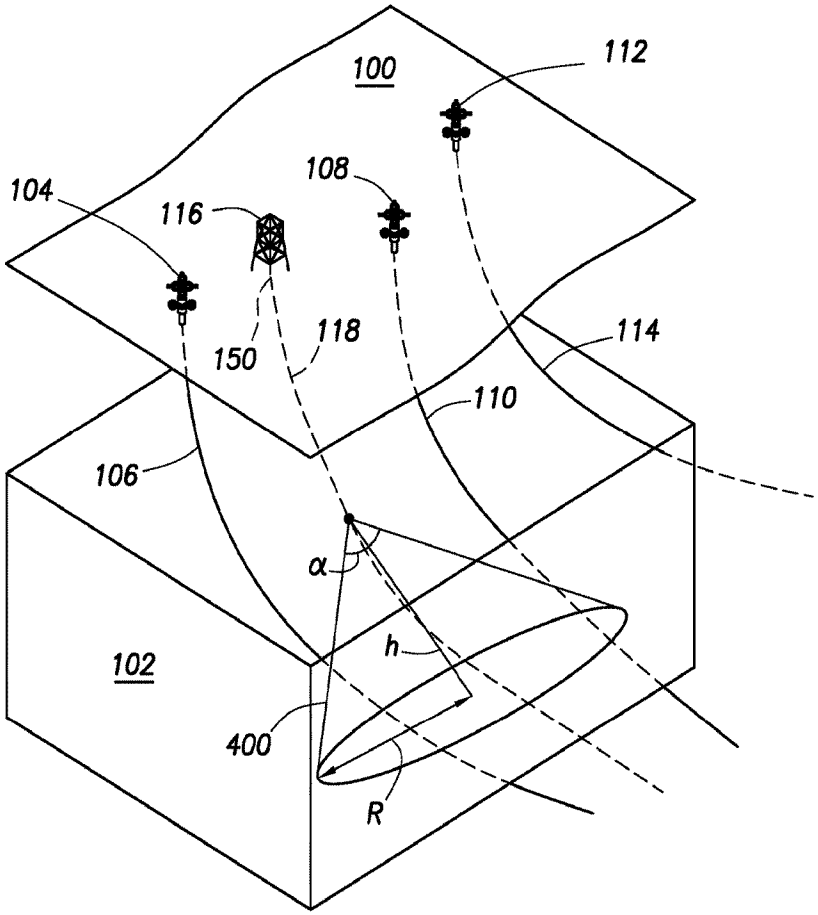
FIG. 4 shows a perspective cutaway view of a portion of a hydrocarbon bearing formation in accordance with at least some embodiments.

FIG. 4 shows a perspective, cut-away view of the earth's crust similar to FIG. 1. In FIG. 4, however, the scanned region is a conical volume. In particular, the conical region 400 defines a volume relative to wellbore 118. In one embodiment, conical region 400 may be a volume having a central axis coaxial with the distal end 122 of wellbore 118, and defined by angle $\alpha$. In another embodiment (not specifically shown in FIG. 4), the conical region may be oriented such that the base of the conical region 400 defines a plane that is parallel with the horizontal plane of surface 100, and with the apex of the conical region 400 at the proximal end 150 of the wellbore 118. The orientation of the cone may have any angle of inclination within the three-dimensional space. For example, although the apex of the cone may be at the distal end 122 of wellbore 118, the central axis of the cone may not coincide with the path of the wellbore, and may be tilted away from the wellbore at any azimuth angle.

Regardless of the shape, size, or orientation within which scanning is performed, scanning identifies offset wells located within predetermined distances of wellbore 118. Once offset wells are identified, data associated with each respective offset well are read and received by a computer system. In one embodiment, the data may be retrieved from real-time information gathering; however, in another embodiment data may be retrieved from a historical database. The computer system then generates a plurality of values indicative of the probability that any number of drilling events may occur with respect to wellbore 118 based on the offset well data. In particular, offset wells within a certain proximity of wellbore 118 may have experienced any number of drilling events (e.g., stuck-pipe even, wellbore collapse, tight hole, loss of circulating fluid, fractures extending to offset wells, blowouts). Based on various uncertainty and probability analyses, including consideration of the number of offset wells identified within the scanned region, the distance of each offset well from wellbore 118, and the depth of the occurrence of each identified drilling event, the probability that any particular drilling event previously recorded may impact the drilling of and production from wellbore 118 may be determined.

Thus, given the probability of the occurrence of a drilling event, drilling parameters related to the drilling of wellbore 118 may be adjusted. In some example systems, the data and probability values themselves may be provided to the drilling engineering during the drilling and/or planning stages. In other example systems, the drilling engineer may be provided a visual "snap-shot" of the probability of drilling events occurring by way of a geometrical shape plotted on a display device. The geometrical shape may visually convey the probability of occurrence a particular drilling event, and may also give an indication as to the direction of offset wells in which the particular drilling event previously occurred. The specification now turns to a discussion of the various ways probability data may be plotted and visualized.

Figure 5:
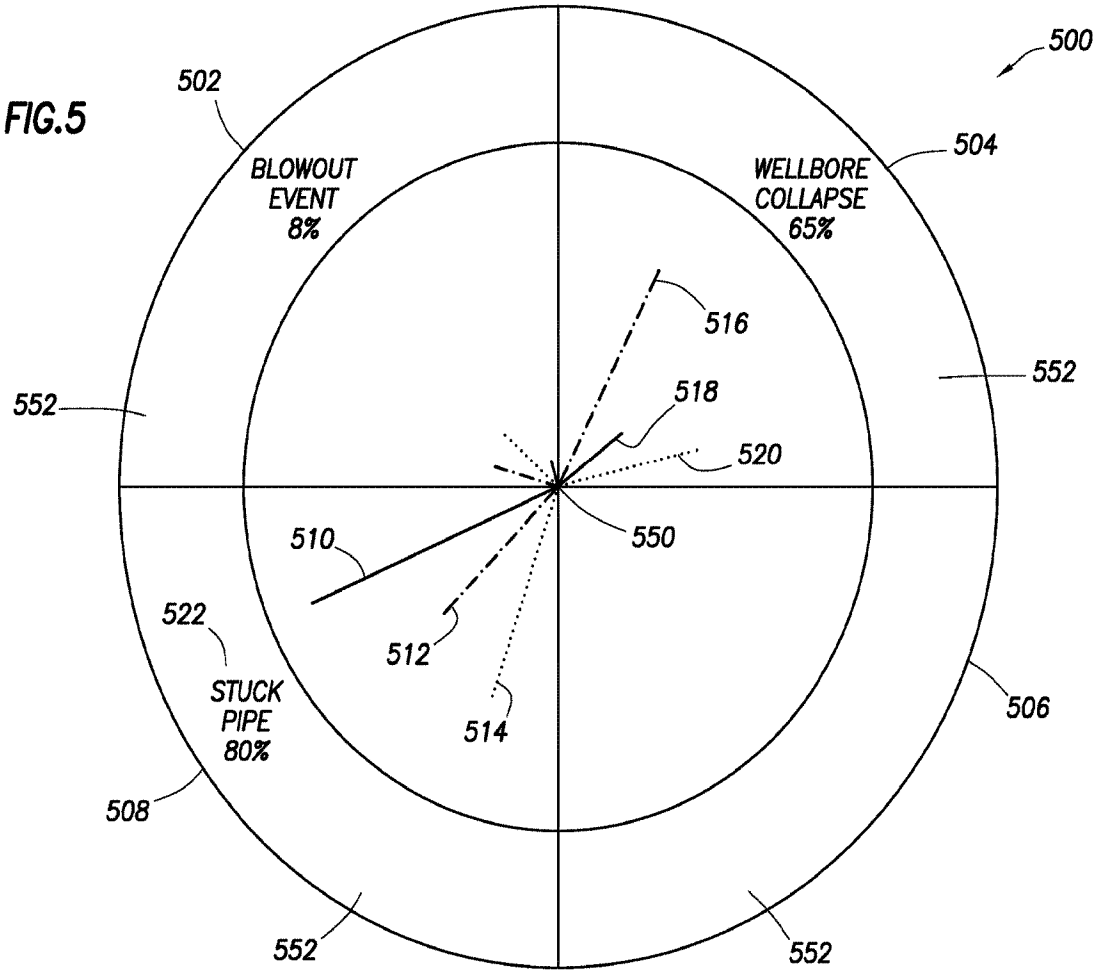
FIG. 5 shows a geometric plot of the probabilities of a plurality of drilling events in accordance with at least some embodiments.

FIG. 5 shows a probability map that may be displayed on a display device of a computer system in accordance with at least some embodiments. In particular, FIG. 5 shows a circular map 500 divided into four example sections 502, 504, 506, and 508. In one embodiment, each of the sections may represent a direction relative to the proximal end 150 of wellbore 118 or the distal end 122 of wellbore 118. For example, section 502 may represent an area to the northwest of wellbore 118, whereas section 504 may represent an area to the northeast of wellbore 118. Although four directional sections are shown in FIG. 5, the divided sections are not limited to four, nor are they limited to cardinal and/or ordinal directions; any directional relationship may be assigned to each divided section in a way that provides directional probability information.

Within each example section, a number of radially extending lines are shown extending outward from the central point 550, where central point 550 may represent the proximal end 150 of wellbore 118 or the distal end 122 of wellbore 118. Each line may be representative of the probability of a particular drilling event occurring in the physical direction indicated by the section position. For example, within section 508, solid line 510 may be representative of the probability of a stuck-pipe event, dash-dot-dashed line 512 may be representative of the probability of wellbore collapse, and dotted line 514 may be representative of the probability of a blowout event. While FIG. 5 shows each drilling event as a different type of line, each drilling event may be associated with and identified by a different color.

The length of each line within each section may represent the probability of each drilling event occurring based on data received from the offset wells. For example, in section 508, line 510 indicating the probability of a stuck-pipe event is greatest, thus indicating that the drilling event most likely to occur in that physical direction relative to wellbore 118 is a stuck-pipe event. In addition, each section may display additional information indicating which drilling event has the highest probability of occurrence, including the percentage probability value. For example, the circular map 500 includes an annular region 552 that abuts the inside diameter of the circular map 500. The portion of the annular region 552 associated with section 508 may be utilized as an information section 522 that shows that in the example southwest direction, the drilling event most likely to occur is a stuck-pipe event having a probability of occurrence of 80%. Using the example circular map 500, engineers can quickly assess probability of the occurrence of a certain drilling event is in certain physical directions, and thus may adjust at least one of the drilling parameters associated with wellbore 118 to reduce the likelihood of the drilling event coming to fruition. By adjusting at least one of the drilling parameters, the probability of wellbore 118 experiencing one of the probable drilling events may be reduced. For example, if it may be predicted that experiencing a stuck-pipe event is probable, the engineer may adjust the pump pressure for the drilling fluid and/or adjust the torque applied to the drill string to help mitigate the chances of the stuck-pipe event.

In another embodiment, as the wellbore 118 drilling continues, the scanned area may change. For example, the region scanned around the wellbore may be of a smaller or larger area or volume, or the region may move farther from the distal end 122 of wellbore 118. Although the newly scanned region may change, the probability of the occurrence of any of drilling events previously calculated may remain the same. This may be based on the fact that the new scan may identify the same wells as in the previous scan. Alternatively, in yet another embodiment, the scanned region around the wellbore may be the same region on a subsequent scanning, but the probability of drilling event occurrences may change.

Figure 6:
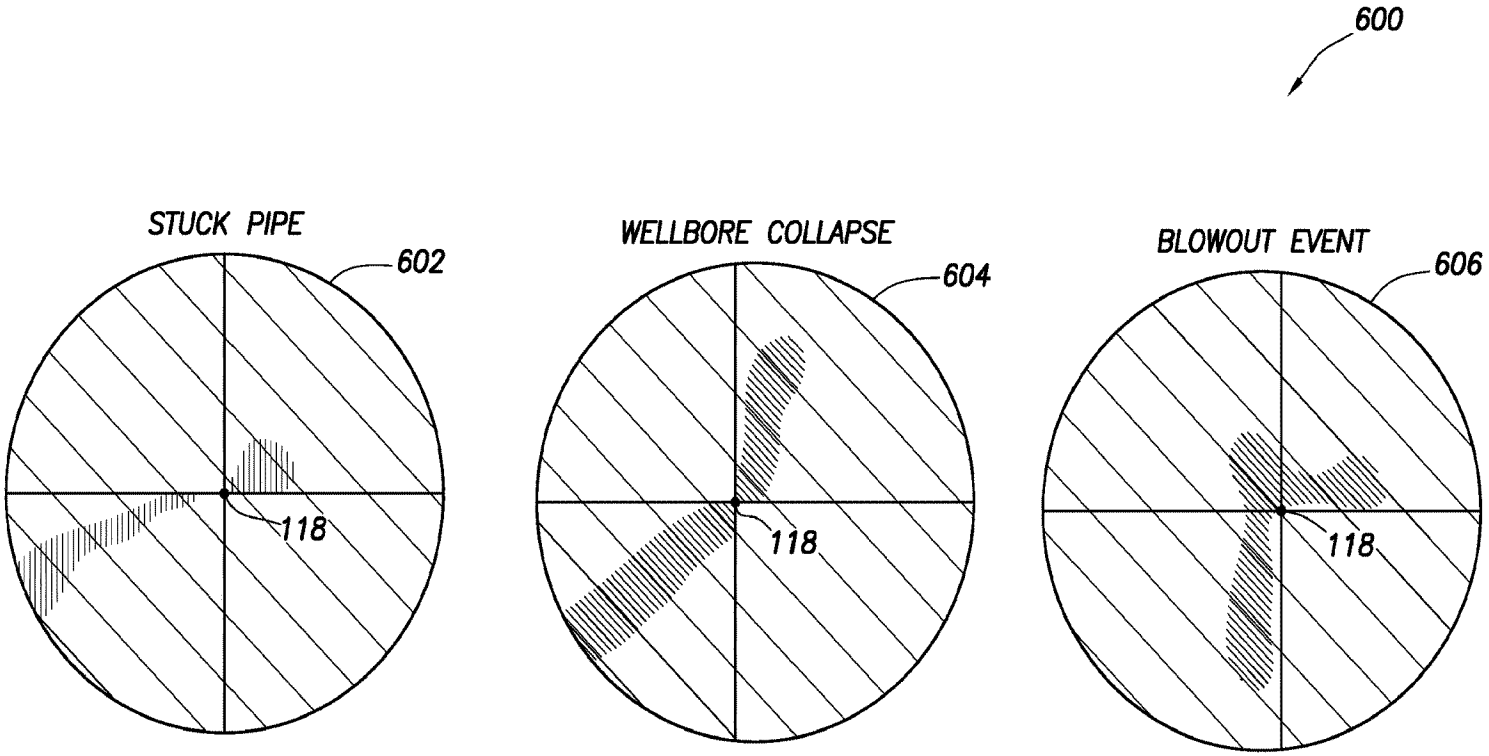
FIG. 6 shows a plurality of heat-maps in accordance with at least some embodiments.

The specification now turns to another type of visualization. In another embodiment, the probability data may be plotted onto a display device in the form of heat-maps where the color, intensity of color, and/or opaqueness of the colors within the map indicate the direction and probability of a certain event, such as shown in FIG. 6. FIG. 6 shows three circular heat-maps, each circle representing the probability of each respective drilling event in a certain direction relative to the wellbore 118. While the heat-maps are shown as circles, any geometric shape may be used in order to convey the direction and probability of each event. Additionally, although each heat-map is shown in black and white with varying density of lines, in practice the heat-maps may be a variety of colors. In particular, each heat-map may represent a different drilling event having a potential effect on wellbore 118. For example, three drilling events are shown in FIG. 6: a stuck-pipe event 602; a wellbore collapse 604; and a blowout event 606. On an example display screen, the color of the stuck-pipe event 602 map may be red; the color of the wellbore collapse map may be blue; and the color of the blowout event 606 map may be green. In another embodiment, the variation in colors, as well as variation of the density or opacity of the colors, may be indicative of the proximity of an offset well to wellbore 118.

In one embodiment, each heat map may be a map relative to the distal end 122 of wellbore 118 (e.g., looking along the path of wellbore 118 toward the distal end 122). In another embodiment, each heat map may be indicative of a map relative to the proximal end 150 of wellbore 118 (e.g., looking down at the wellbore 118 from above such that a plane defined by each heat map is parallel to surface 100). Regardless of the orientation, the colors of the heat-map and the density or opacity of the colors in a certain direction are indicative of the probability of each specific drilling event occurring in a specific physical direction with respect to wellbore 118.

For example, looking at the stuck-pipe heat map 602, wellbore 118 is represented as being located in the center of the heat-map, with densest section radiating to the left-bottom section of the heat-map. It can then be determined at a glance that the probability of a stuck-pipe event for wellbore 118 is highest in the physical direction corresponding to the left-bottom section, where the density is greatest. Additionally, there is a slightly less dense color section radiating to the upper-right section of the heat-map 602 indicating where there is a higher probability of the stuck-pipe event, although the probability is not as great as to the left-bottom. The wellbore collapse heat-map 604 shows there is a fairly equal probability of a wellbore collapse happening in the physical directions corresponding to the bottom-left and the upper-right of wellbore 118. Furthermore, the blowout event heat-map 606 shows the probability of a blowout event as being greatest in three directions relative to the wellbore 118, as seen by the denser sections. In other cases, the relative size of each individual drilling event heat-map compared to other individual drilling event heat-maps may provide other valuable analysis.

Figure 7:
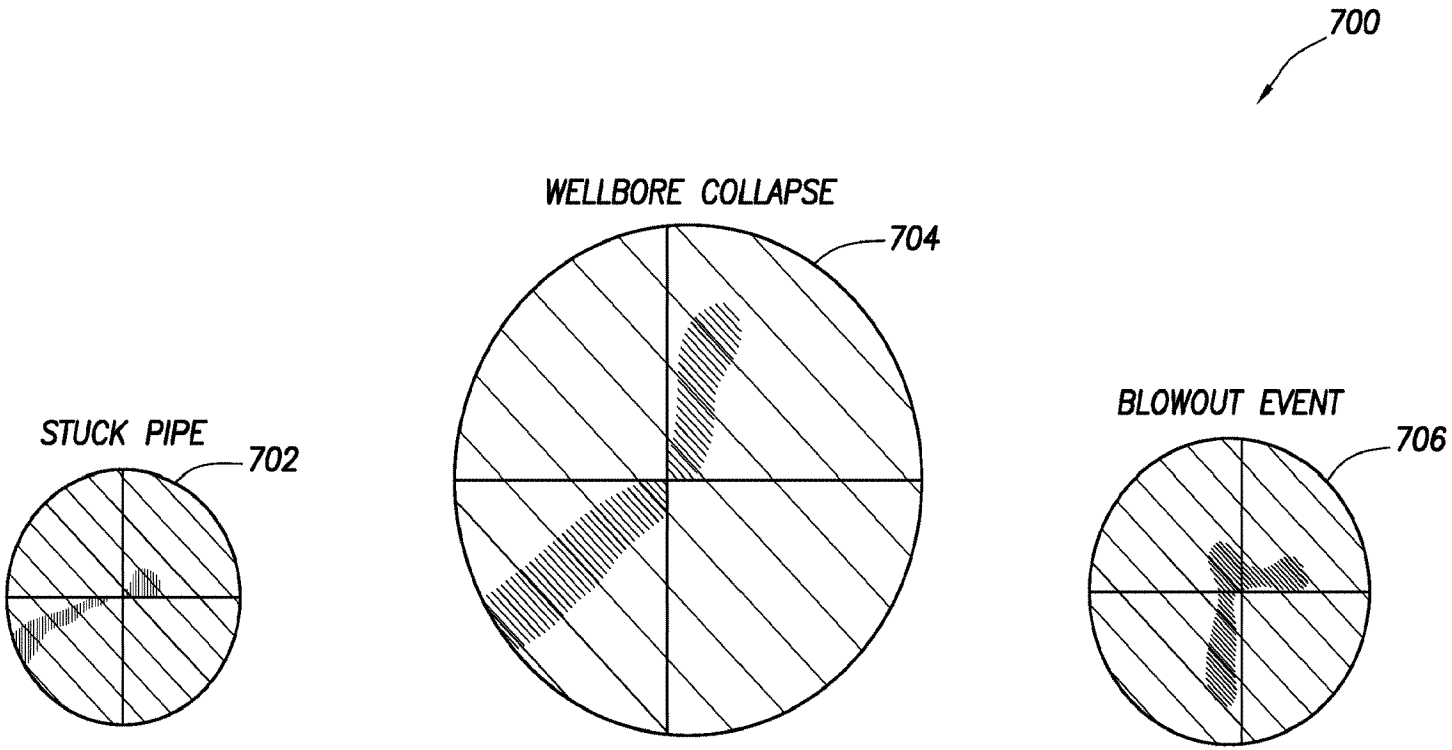
FIG. 7 shows a plurality of heat-maps in accordance with at least some embodiments.

FIG. 7 shows three example heat-maps where size or radius depicts relative probability of occurrence as between drilling events associated with each heat map. In particular, the same three drilling events from FIG. 6 are plotted as probability heat-maps; however, in FIG. 7 each heat-map has been scaled to a size demonstrating each heat-map's relative probability to the other heat-maps. For example, in FIG. 7, the wellbore collapse heat-map 704 is the largest, with the blowout event heat-map 706 second largest, and the stuck-pipe heat-map 702 being the smallest. The relative sizes of each heat map may be indicative that the probability of a wellbore collapse is much more likely to occur than the other two events. In addition, the heat maps may also visually convey probability of each drilling event as a function of physical direction in a manner similar to that discussed with respect to FIG. 6.

As with FIG. 6, in practice the heat-maps of FIG. 7 may be color-coded so as to provide easy identification of each event. Furthermore, although not particularly shown so as not to unduly complicate the figure, in another embodiment the heat-maps overlap one another if the direction of certain events is probable in overlapping directions. For example, in FIGS. 6 and 7, there is directional probability of both a stuck-pipe event and a wellbore collapse occurring in the direction indicated by the bottom-left section, and thus it may be possible to overlap the heat-maps for the stuck-pipe and the wellbore collapse events in order to provide a more thorough analysis.

Once the probability analysis has been calculated and plotted, it may be determined that one or more planned or actual drilling parameters of wellbore 118 should be adjusted. While it may not be possible to completely avoid one of the possible drilling events with the continued drilling of wellbore 118, adjusting one or more of the drilling parameters may help in lessening the potential impacts of a drilling event. In addition, the heat-maps, radial maps, or any of the probability data that is calculated and plotted may be saved for retrieval and analysis at a later time or date.

Figure 8:
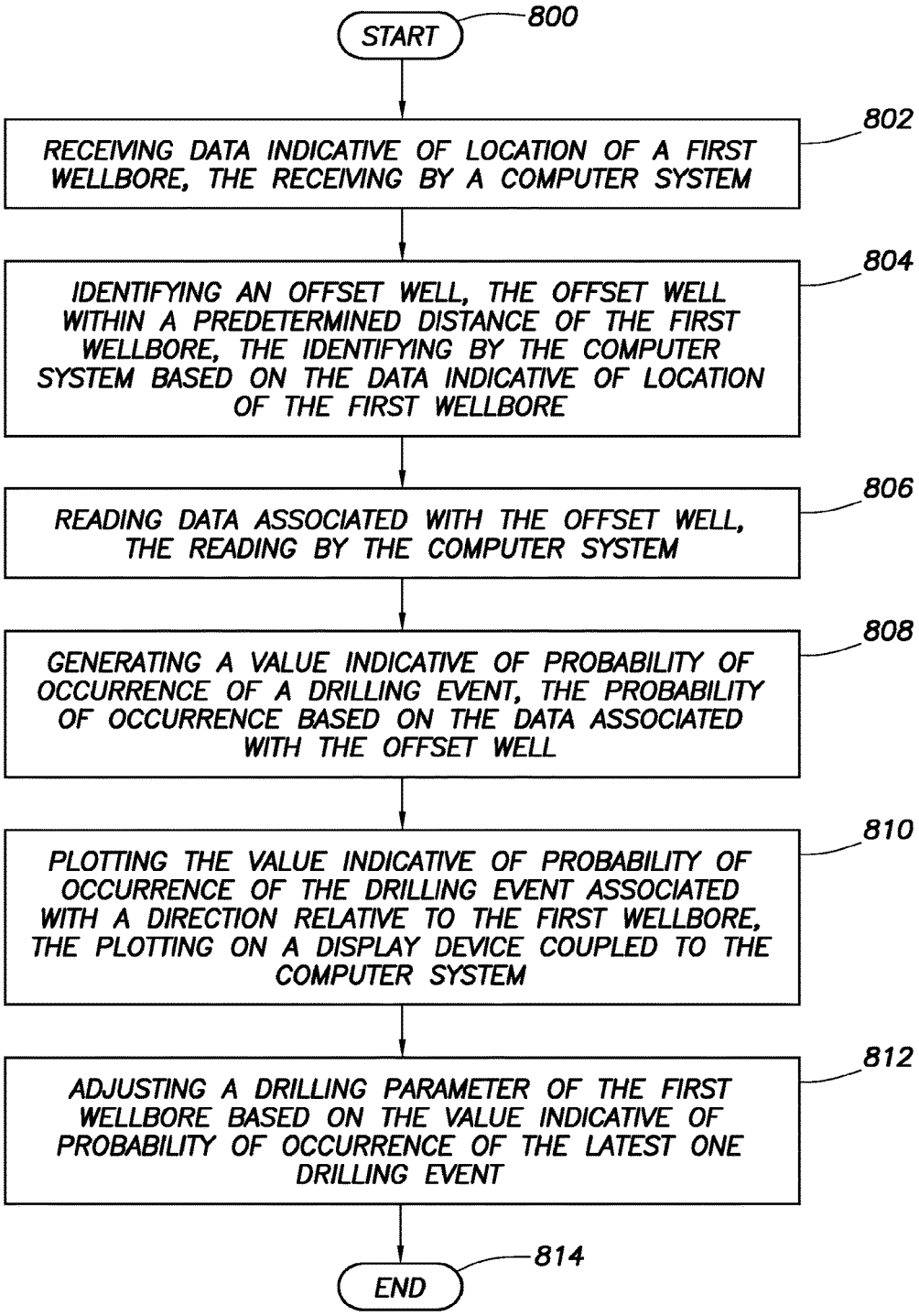
FIG. 8 shows a method in accordance with at least some embodiments.

FIG. 8 shows a flow diagram depicting an overall method. The method starts (block 800) and proceeds to: receiving data indicative of location of a first wellbore, the receiving by a computer system (block 802); identifying an offset well, the offset well within a predetermined distance of the first wellbore, the identifying by the computer system based on the data indicative of location of the first wellbore (block 804); reading data associated with the offset well, the reading by the computer system (block 806); generating a value indicative of probability of occurrence of a drilling event, the probability of occurrence based on the data associated with the offset well (block 808); plotting the value indicative of probability of occurrence of the drilling event associated with a direction relative to the first wellbore, the plotting on a display device coupled to the computer system (block 810); and then adjusting a drilling parameter of the first wellbore based on the value indicative of probability of occurrence of the at least one drilling event (block 812). Thereafter, the method ends (block 814).

Figure 9:
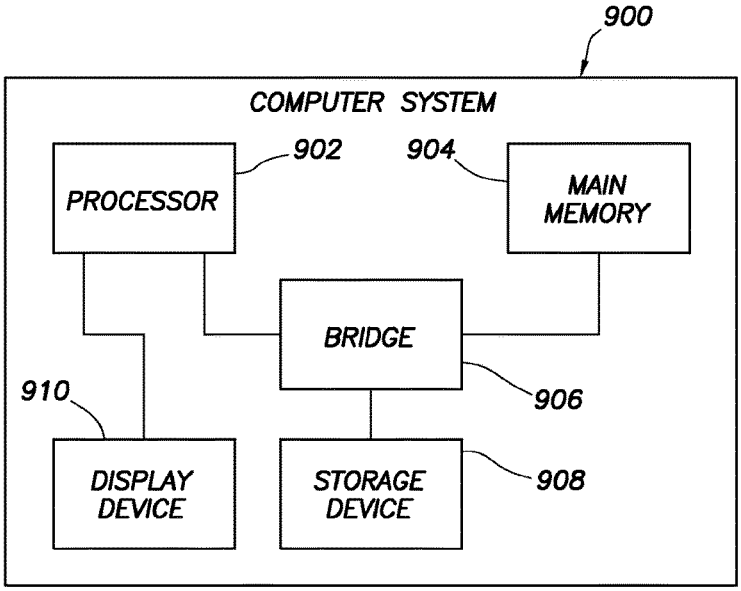
FIG. 9 shows a computer system in accordance with at least some embodiments.

FIG. 9 shows a computer system 900, which is illustrative of a computer system upon which the various embodiments may be practiced. The computer system 900 comprises a processor 902, and the processor couples to a display device 910 and a main memory 904 by way of a bridge device 906. It is on the display device 910 that the various example geometric shapes that correspond to probability of a drilling event associated with a physical direction may be plotted. Moreover, the processor 902 may couple to a long term storage device 908 (e.g., a hard drive, solid state disk, memory stick, optical disc) by way of the bridge device 906. Programs executable by the processor 902 may be stored on the storage device 908, and accessed when needed by the processor 902. In some cases, the programs are copied from the storage device 908 to the main memory 904, and the programs are executed from the main memory 904. Thus, the main memory 904, and storage device 908 shall be considered computer-readable storage mediums.

It is noted that while theoretically possible to perform some or all the tracking, ranking, and providing of knowledge related to tasks discussed above by a human using only pencil and paper, the time measurements for human-based performance of such tasks may range from man-hours to man-years, if not more. Thus, this paragraph shall serve as support for any claim limitation now existing, or later added, setting forth that the period of time to perform any task described herein less than the time required to perform the task by hand, less than half the time to perform the task by hand, and less than one quarter of the time to perform the task by hand, where "by hand" shall refer to performing the work using exclusively pencil and paper.

From the description provided herein, those skilled in the art are readily able to combine software created as described with appropriate general-purpose or special-purpose computer hardware to create a computer system and/or computer sub-components in accordance with the various embodiments, to create a computer system and/or computer sub-components for carrying out the methods of the various embodiments, and/or to create a non-transitory computer-readable storage medium (i.e., other than an signal traveling along a conductor or carrier wave) for storing a software program to implement the method aspects of the various embodiments.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method comprising:

receiving, by a computer system, data indicative of a location of a first wellbore being drilled through a formation;

identifying, by the computer system, one or more offset wells within a scanned area of the formation in proximity to the location of the first wellbore as it is being drilled through the formation, based on the received data;

reading, by the computer system, data regarding a plurality of drilling events that had previously occurred with respect to the one or more offset wells identified within the scanned area as the first wellbore is being drilled, the read data including a distance of each identified offset well from the location of the first wellbore and a depth at which each drilling event occurred with respect to that offset well;

generating, by the computer system, a value indicative of a probability of occurrence of at least one drilling event in the plurality of drilling events for a planned path of the first wellbore to be drilled through the formation, based on the data regarding the plurality of drilling events;

adjusting the planned path of the first wellbore so as to reduce the probability of occurrence of the at least one drilling event, based on the generated value; and drilling the first wellbore along the adjusted path through the formation.

2. The method of claim 1 wherein the data indicative of the location of the first wellbore includes data indicative of the location and a drilling direction of the first wellbore.

3. The method of claim 1 wherein the scanned area is defined by a circle of a predetermined radius extending horizontally outward from the first wellbore.

4. The method of claim 1 wherein the scanned area is a cylindrical volume having a central axis coaxial with the first wellbore.

5. The method of claim 1 wherein the scanned area is a cylindrical volume having a central axis that is coaxial with a distal end of the first wellbore.

6. The method of claim 1 wherein the scanned area is a conical volume having a central axis that is coaxial with a distal end of the first wellbore.

7. The method of claim 1, further comprising:

plotting, on a display device coupled to the computer system, the value indicative of probability of occurrence of the at least one drilling event as a function of direction relative to the planned path of the first wellbore.

8. The method of claim 1 wherein the plurality of drilling events are selected from the group consisting of: a stuck-pipe event; a wellbore collapse; a tight hole; a loss of circulating fluid; a fracture extending to an offset well; and a blowout event.

9. The method of claim 7 wherein the plotting further comprises plotting a geometrical shape that corresponds to a plurality of physical directions, and an attribute of the geometrical shape is indicative of the probability of the at least one drilling event occurring for the planned path of the first wellbore as a function of each direction of the plurality of physical direction.

10. The method of claim 9 wherein the attribute is selected from the group consisting of: color; color intensity; opaqueness; and radius.

11. The method of claim 9 wherein plotting the geometrical shape further comprises plotting a circular shape radially divided into a plurality of sections corresponding to the plurality of physical directions, and plotting within each section a radially extending line segment having a length proportional to the value indicative of the probability of occurrence of the at least one drilling event in the respective physical direction.

12. A system comprising:

a processor;

a memory coupled to the processor;

a display device coupled to the processor;

wherein the memory storing instructions that, when executed by the processor, cause the processor to:

retrieve data indicative of a location of a first wellbore being drilled through a formation;

identify one or more offset wells within a scanned area of the formation in proximity to the location of the first wellbore as it is being drilled through the formation, based on the retrieved data;

read data regarding a plurality of drilling events that had previously occurred with respect to the one or more offset wells identified within the scanned area as the first wellbore is being drilled, the read data including a distance of each identified offset well from the location of the first wellbore and a depth at which each drilling event occurred with respect to that offset well;

generate a first value indicative of a probability of occurrence of a first drilling event associated with a first direction relative to a planned path of the first wellbore to be drilled through the formation, based on the data regarding the plurality of drilling events;

generate a second value indicative of a probability of occurrence of a second drilling event associated with a second direction relative to the planned path of the first wellbore, based on the data regarding the plurality of drilling events;

adjust the planned path of the first wellbore so as to reduce the probability of occurrence of the first and second drilling events as the first wellbore is drilled through the formation, based on the respective first and second values; and drill the first wellbore along the adjusted path through the formation.

13. The system of claim 12 wherein the instructions further cause the processor to plot, on the display device coupled to the processor, the first and second values indicative of probability of occurrence of the respective first and second drilling events as a function of the first and second directions relative to the planned path of the first wellbore.

14. The system of claim 12 wherein the retrieved data indicative of the location of the first wellbore includes data indicative of the planned path of the first wellbore from a drilling plan.

15. The system of claim 12 wherein the scanned area is defined by a circle of a predetermined radius extending from the first wellbore.

16. The system of claim 12 wherein the scanned area is a cylindrical volume having a central axis that is coaxial with a drilled path of the first wellbore.

17. The system of claim 12 wherein the scanned area is a conical volume having a central axis that is coaxial with the first wellbore.

18. The system of claim 12 wherein the plurality of drilling events are selected from the group consisting of: a stuck-pipe event; a wellbore collapse; a tight hole; a loss of circulating fluid; a fracture extending to an offset well; and a blowout event.

19. The system of claim 12 wherein the instructions further cause the processor to plot on the display device a geometrical shape that corresponds to a plurality of physical directions, and wherein a first attribute of the geometrical shape is indicative of the first value indicative of probability, a second attribute of the geometrical shape is indicative of the second value indicative of probability, and the first and second attributes are plotted as a function of direction.

20. The system of claim 19 wherein each of the first and second attributes of the geometrical shape are selected from the group consisting of: color, color intensity; opaqueness; and radius.

21. The system of claim 19 wherein when the processor plots the geometric shape, the instructions cause the processor to plot a circular shape radially divided into a plurality of sections corresponding to the plurality of physical directions, and plot within each section a radially extending line segment having a length proportional to the first value indicative of probability of occurrence of the drilling event in the respective physical direction.

22. A non-transitory computer-readable medium storing a program that, when executed by a processor, causes the processor to:

retrieve data indicative of a location of a first wellbore being drilled through a formation along a planned path;

identify one or more offset wells within a scanned area of the formation in proximity to the location of the first wellbore as it is being drilled through the formation, based on the retrieved data;

read data regarding a plurality of drilling events that had previously occurred with respect to the one or more offset wells identified within the scanned area as the first wellbore is being drilled, the read data including a distance of each identified offset well from the location of the first wellbore and a depth at which each drilling event occurred with respect to that offset well;

generate a first value indicative of a probability of occurrence of a first drilling event associated with a first direction relative to a planned path of the first wellbore to be drilled through the formation, based on the data regarding the plurality of drilling events;

generate a second value indicative of a probability of occurrence of a second drilling event associated with a second direction relative to the planned path of the first wellbore, based on the data regarding the plurality of drilling events; and adjust the planned path of the first wellbore so as to reduce the probability of occurrence of the first and second drilling events as the first wellbore is drilled through the formation, based on the respective first and second values, wherein the first wellbore is drilled along the adjusted path through the formation.

23. The non-transitory computer-readable medium of claim 22 wherein the program further causes the processor to plot, on a display device coupled to the processor, the first and second values indicative of probability of occurrence of the respective first and second drilling events as a function of the first and second directions relative to the planned path of the first wellbore.

24. The non-transitory computer-readable medium of claim 22 wherein the retrieved data indicative of the location of the first wellbore includes data indicative of the planned path of the first wellbore from a drilling plan.

25. The non-transitory computer-readable medium of claim 22 wherein the scanned area is defined by a circle of a predetermined radius extending outward from the first wellbore.

26. The non-transitory computer-readable medium of claim 22 wherein the scanned area is a cylindrical volume having a central axis that is coaxial with the first wellbore.

27. The non-transitory computer-readable medium of claim 22 wherein the scanned area is a conical volume having a central axis that is coaxial with the first wellbore.

28. The non-transitory computer-readable medium of claim 22 wherein the plurality of drilling events are selected from the group consisting of: a stuck-pipe event; a wellbore collapse; a tight hole; a loss of circulating fluid; a fracture extending to an offset well; and a blowout event.

29. The non-transitory computer-readable medium of claim 22 wherein the program further causes the processor to plot on the a display device a geometrical shape that corresponds to a plurality of physical directions, and wherein a first attribute of the geometrical shape is indicative of the first value indicative of probability, a second attribute of the geometrical shape is indicative of the second value indicative of probability, and the first and second attributes are plotted as a function of direction.

30. The non-transitory computer-readable medium of claim 29 wherein when the processor plots the geometric shape, the program causes the processor to plot a circular shape radially divided into a plurality of sections corresponding to the plurality of physical directions, and plot within each section a radially extending line segment having a length proportional to the first value indicative of probability of occurrence of the drilling event in the respective physical direction.

* * * * *